US008678209B2

(12) United States Patent
Chernyak

(10) Patent No.: US 8,678,209 B2
(45) Date of Patent: Mar. 25, 2014

(54) GANTRY CRANE HAVING A TRUSS SUPPORTED RUNWAY

(75) Inventor: Alexander Z. Chernyak, Pittsford, NY (US)

(73) Assignee: Gorbel, Inc., Fishers, NY (US)

( * ) Notice: Subject to any disclaimer, the term of this patent is extended or adjusted under 35 U.S.C. 154(b) by 191 days.

(21) Appl. No.: 13/085,694

(22) Filed: Apr. 13, 2011

(65) Prior Publication Data

US 2011/0247993 A1 Oct. 13, 2011

Related U.S. Application Data

(60) Provisional application No. 61/323,402, filed on Apr. 13, 2010.

(51) Int. Cl.
*B66C 5/02* (2006.01)

(52) U.S. Cl.
USPC ..... 212/324; 212/312; 212/319; 212/322

(58) Field of Classification Search
USPC ..... 212/312, 319, 320–323, 324, 327, 271; 52/650.1, 651.05; 414/542; 104/137
See application file for complete search history.

(56) References Cited

U.S. PATENT DOCUMENTS

| | | | | |
|---|---|---|---|---|
| 3,863,771 | A * | 2/1975 | Dobbie et al. | 212/316 |
| 4,273,242 | A * | 6/1981 | Schaper | 212/273 |
| 5,743,702 | A * | 4/1998 | Gunderson | 414/542 |
| 7,413,394 | B2 * | 8/2008 | Risser | 414/542 |

OTHER PUBLICATIONS

Free Standing Work Station Bridge Cranes, C. 2008, Gorbel, Inc., 600 Fishers Run, PO Box 593, Fishers, NY 14453; pp. 1-39 (With Cover Sheets Total 42 pages).

* cited by examiner

*Primary Examiner* — Emmanuel M Marcelo
*Assistant Examiner* — Angela Caligiuri
(74) *Attorney, Agent, or Firm* — Duane C. Basch; Basch & Nickerson LLP

(57) ABSTRACT

Disclosed are systems and methods for providing a user installable gantry crane, wherein the gantry runways, supported by columns, utilize a lightweight truss, having a high weight to strength modulus, that permits assembly of the system without the need for rigging equipment.

20 Claims, 6 Drawing Sheets

206A

206B

206C

206D

206E

206F

500
FIG. 5A
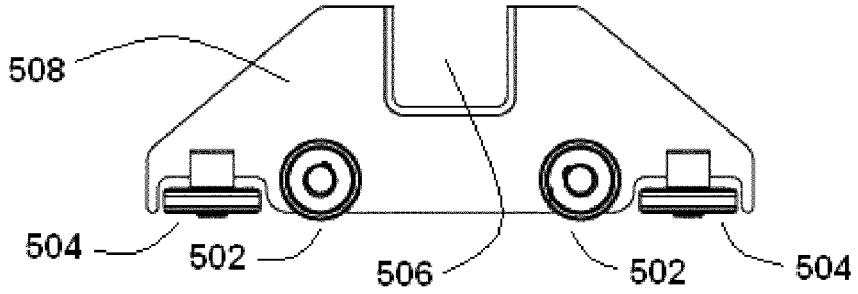
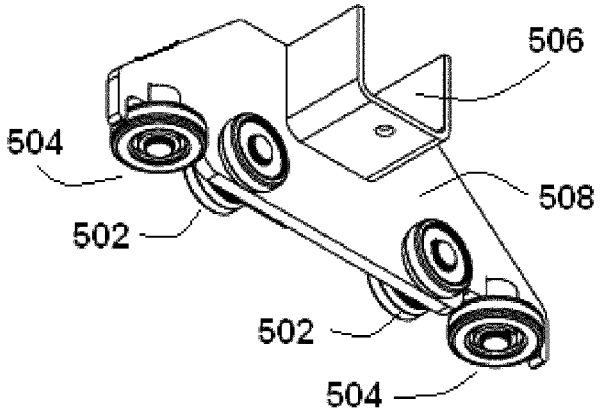
FIG. 5B

GANTRY CRANE HAVING A TRUSS SUPPORTED RUNWAY

This application claims priority under 35 USC 119(e) from U.S. Provisional Patent Application No. 61/323,402, filed Apr. 13, 2010, by Alexander Z. Chernyak, which is hereby incorporated by reference in its entirety.

The disclosed embodiment is directed to an improved gantry-type overhead lifting system that utilizes a truss design for the gantry support tracks or runways. More specifically, the truss design enables a lighter-weight and easy to assemble gantry crane suitable for commercial use, as well as residential purposes when combined with a conventional wire rope, or chain, hoist or pulley system.

BACKGROUND AND SUMMARY

Freestanding bridge or gantry type cranes for lifting systems are well-known. An example of such systems is found in the brochure published by Gorbel, Inc. (assignee), titled "FREE STANDING WORK STATION BRIDGE CRANES," © 2008, which is incorporated herein by reference in its entirety. However, such systems are not often practical for small garages, and work areas having limited overhead clearances and confined areas in which to install traditional overhead gantry systems. To address the need for a light duty, economical lifting system, the embodiments disclosed herein provide a lifting system that can be self-installed by a minimum of two people, without the assistance of rigging equipment. The system further maximizes the lifting height by employing a runway design that does not waste limited overhead space in garage bays and similar work areas.

Disclosed in embodiments herein is an improved overhead lifting system, comprising: at least two pairs of upright support columns arranged to define corners of a rectangular area; a pair of lightweight parallel crane runways, reinforced by trusses, spanning each of said pair of columns, said runways being attached to the tops of the columns; and a movable crane bridge member perpendicular to and spanning a distance between the pair of crane runway trusses, said crane bridge member being slidably connected to the runways to permit each end of the bridge member to move in unison along the entire linear path defined by the respective crane runways.

Further disclosed in embodiments herein is an improved gantry crane runway, comprising: an upper most U-shaped channel in which an end-truck travels along the length of the channel; and a linear truss type reinforcement attached to the C-channel underside, said reinforcement defining, in conjunction with said C-channel, a plurality of triangular reinforcement sections.

Also disclosed in embodiments described herein is a method for constructing the gantry crane system with truss supported runways, comprising: installing two pairs of support columns, each of said columns placed in a vertical orientation at respective corners of a rectangular region (e.g., having a perimeter dimension of about 10×15 feet and a nominal column height of about 10 feet), said columns being attached to a level floor or similar substructure using ¾ anchor bolts; attaching a pair of parallel gantry crane runways spanning each of said pair of columns along the length of the rectangle, said runways being placed on top of and subsequently bolted to the columns; and placing, on top of the runways a movable bridge member perpendicular to and spanning a distance between the pair of gantry crane runways, said bridge member being slidably connected to the runways via an end truck to permit each end of the bridge member to move along a linear path defined by the respective gantry crane runways.

BRIEF DESCRIPTION OF THE DRAWINGS

FIG. 5A is a planar view of the end truck assembly;

FIG. 5B is a perspective view of the underside of the end truck assembly;

The various embodiments described herein are not intended to limit the invention to those embodiments described. On the contrary, the intent is to cover all alternatives, modifications, and equivalents as may be included within the spirit and scope of the invention as defined by the appended claims.

DETAILED DESCRIPTION

Figure 1:
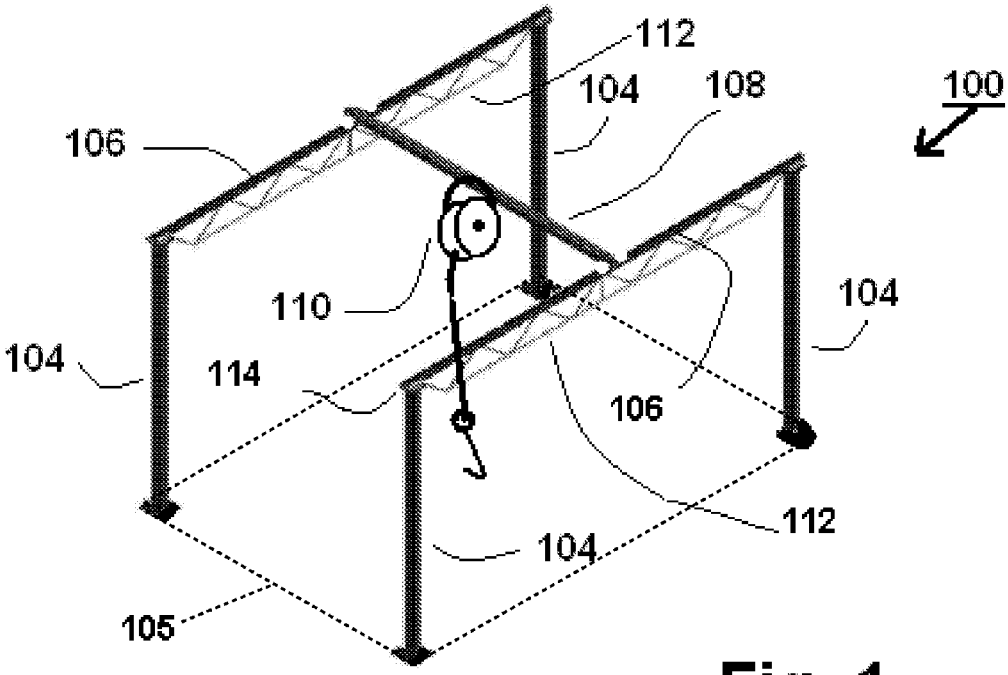
FIG. 1 is a perspective view of an assembled rafter truss gantry system.
Figure 4A:
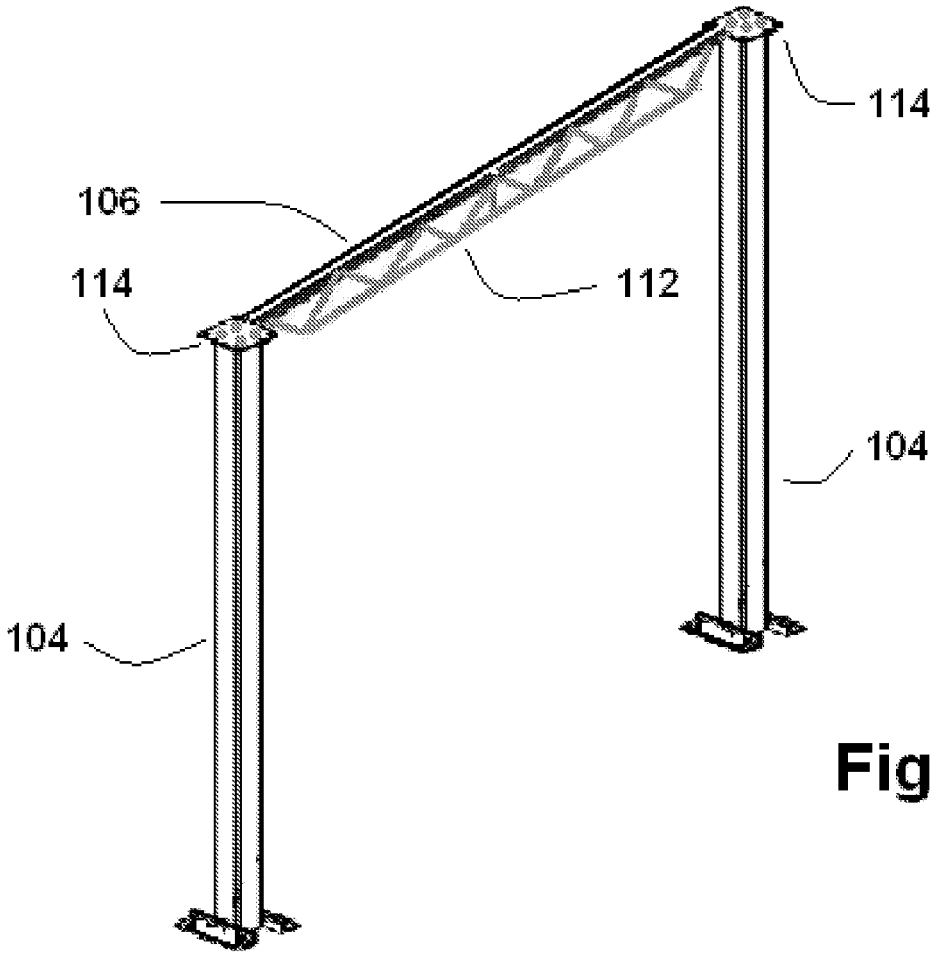
FIG. 4A is a perspective view of a pair of columns and an associated runway.
Figure 4B:
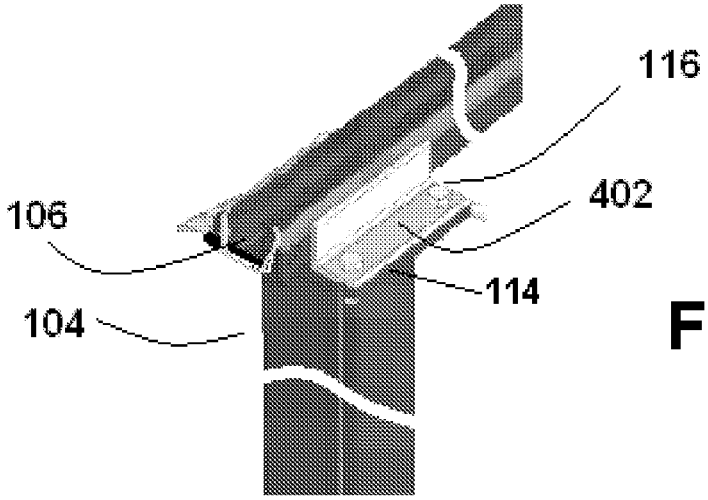
FIG. 4B is a perspective view of the flange employed on the top of the columns to attach the runway thereto.
Figure 6:
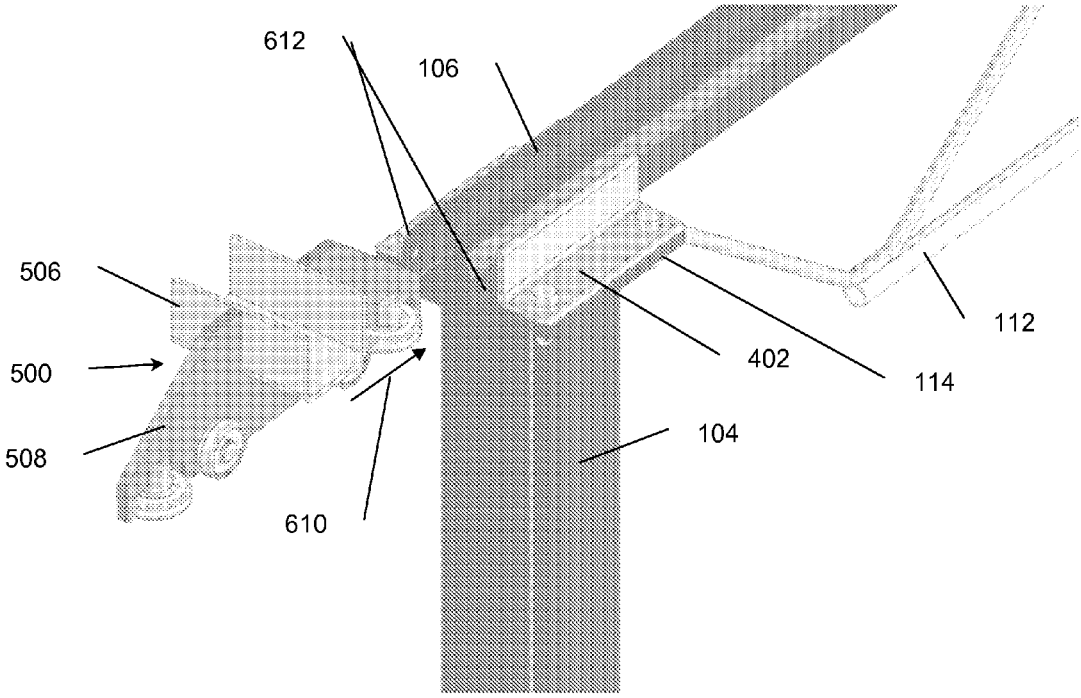
FIG. 6 is a perspective view of the end truck being inserted into the runway during assembly.

As more particularly set forth below, the disclosed system and methods may be employed to facilitate a workstation utilizing a gantry-type crane system. Referring to FIG. 1, for example, the space efficient, lightweight gantry-type overhead lifting system 100 includes at least two pairs of upright support columns 104 arranged to define corners of a rectangular area (105). Affixed atop the columns are a pair of parallel crane runways 106 spanning each of said pair of columns 104; the runways 106 being bolted to flanges 114 (also see FIG. 4B, angle 402 attached to runway 106) on the tops of the columns 104, so as to avoid the need for any hangers or angled braces to further secure the runways 106 to the columns 104. A movable bridge member 108 is placed perpendicular to and spanning a distance between the pair of gantry crane runways 106 (for example, approx. 120 inches). Bridge member 108 is formed from an inverted C-channel and a reinforcement (e.g., structural tubing) on the top thereof, and is slidably connected to the runways using end trucks (FIGS. 5A and 5B) to permit each end of bridge member 108 to move along a linear path defined by the respective gantry crane runways 106.

It will be appreciated that while a single gantry is displayed in the figures, it may be possible to interconnect a plurality of runways 106 and additional columns 104 to enable bridge 108 to traverse an extended work space. It is also possible that an extended runway (greater than the exemplary 189 inch runway depicted) may be created using a longer truss comprising additional triangular reinforcement sections per unit length, as well as an increase in the cross sectional area of the zigzag struts 202 and parallel chords 204. In the alternative, the required truss rigidity may be accomplished using one or more of the truss configurations 206A-206F depicted in FIGS. 3A-F, respectively, as well as combinations thereof.

A truss is a structural beam relying upon an arrangement of struts and parallel chords to transfer loads to reaction points at either end, which provides a high strength-to-weight ratio. In one embodiment, the truss configuration 206, consists of a pair of longitudinal chords 204, joined by angled cross-struts 202, forming alternately inverted equilateral triangle-shaped reinforcement sections along its entire length, whereby no individual strut is subjected to bending or torsional forces. Accordingly, loads on the diagonal struts alternate between compression and tension and provide truss 112 with a high strength modulus to truss weight ratio. Thus, the truss is relatively light in view of the maximum load carrying capacity (approx. 1400 pounds for the runway truss illustrated). The struts may be constructed from ordinary concrete reinforcement bars (re-bar) and chords 204 can also be hollow thereby permitting the use of the either chord as a passageway or conduit for pneumatic, electrical or hydraulic power lines and the like.

Figure 2A:
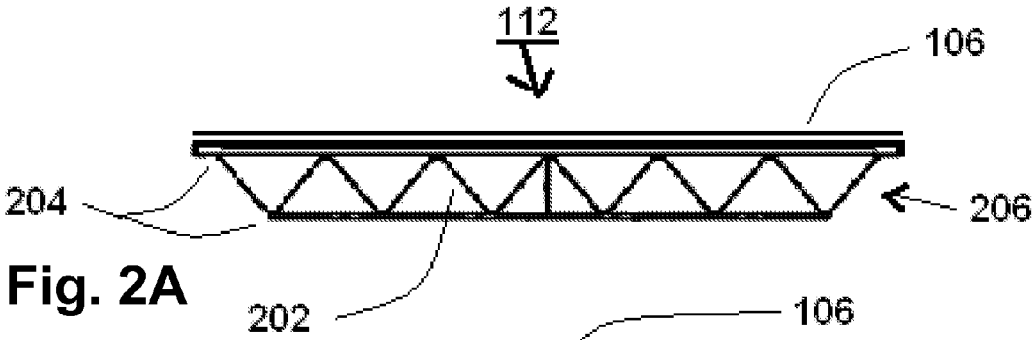
FIG. 2A is a frontal view of an exemplary runway truss.
Figure 2B:
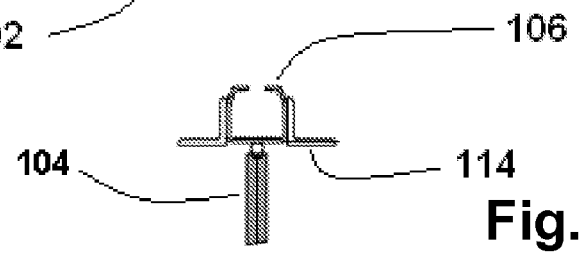
FIG. 2B is an end view of the exemplary runway truss of FIG. 2A.

Now, FIG. 2A depicts a hybrid truss, whereby a single vertical member is placed at the center of the truss matrix to improve the load capacity at the point of the maximum moment. Truss 112 also includes C-channel 106 that is welded to the top side of upper chord 204 to provide a runway for the guidance of bridge member 108, as it traverses the channel 106.

Figure 3A:
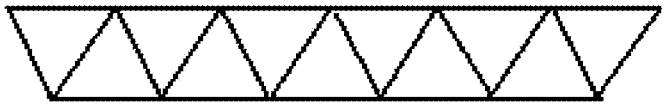
FIGS. 3 A-F are various alternative truss designs.
Figure 3B:
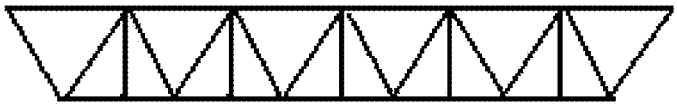
Figure 3C:
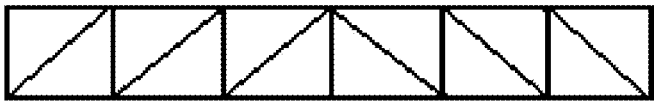
Figure 3D:
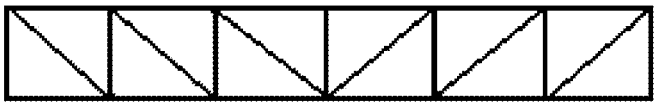
Figure 3E:
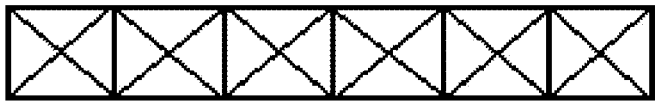
Figure 3F:
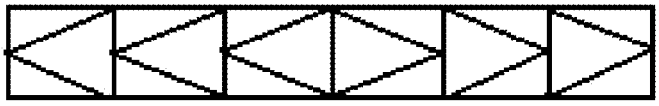

FIG. 3A illustrates a variation to the truss, where no vertical support is provided at the center. FIG. 3B is a variation where truss 206B has parallel chords that are further connected, as in truss 112, with vertical struts between the diagonals, thereby providing additional rigidity and loading capacity. FIG. 3C shows what is commonly referred to as a Pratt truss, which includes vertical struts in combination with intermediary 60-degree diagonals sloping to and from the center vertical strut. FIG. 3D depicts the converse configuration of the Pratt truss, known in the industry as a Howe truss, whereby vertical struts occur in combination with diagonal struts sloping in opposite directions. In contrast to the Pratt truss, the diagonal struts members of the Howe truss are in compression and the vertical strut members are in tension. An additional truss configuration, as shown in FIG. 3E, is the Howe truss design used in combination with the Pratt truss, that provides an "X" configuration, thereby increasing the capacity with a nominal increase in the weight of the truss. While the Howe/Pratt X truss superimposes the two, yet another variation, as seen in FIG. 3F, which effectively positions the Howe design connected above the Pratt design to form a Howe/Pratt K truss. The intent of the K truss is to segment the diagonal struts midway to form adjacent equilateral and right triangles in order to resist buckling from the compression forces. As will be appreciated the alternative truss designs are provided to illustrate that alternative designs may be employed and the disclosed embodiments are not limited to the truss design depicted in the various embodiments.

The lightweight gantry system of FIG. 1 also includes vertical lifting mechanism 110 suspended from the movable bridge member 108 via a wheeled trolley 508. As will be appreciated the use of a lift or a series of pulleys may provide an operator a mechanical advantage when raising an object. Examples of such a lift include a conventional wire rope or chain hoist, and a pulley system (e.g., block-and-tackle, chain fall). Various powered lifting mechanisms are suitable, for example electrical or pneumatic devices such as those available from Gorbel, Inc., including those described in the publication, "FREE STANDING WORK STATION BRIDGE CRANES," © 2008 Gorbel, Inc., which was previously incorporated herein by reference. The movable bridge member 108, in combination with lifting mechanism 110, is positioned above the truss 112 such that the configuration assures that the lifting height of the system is maximized as no vertical height is forfeited by the runways and the reinforcement of such runways being positioned above the lifting mechanism 110.

A significant advantage of this gantry design is the absolute minimal effort required for installation. The simple assembly properties, combined with the reduced weight of the system, provide an industrial style gantry to the marketplace because the system may be installed and assembled without the need for rigging equipment. In other words, individuals with a step ladder are able to simply lift and place the lightweight runway truss assembly on top of flange 114 of column 104, while securing the runways to the column tops with one or more bolts 116. Notably, because the runways sit atop of the columns it is not necessary to suspend or hold truss 112 up while it is being affixed to column flange 114, attached to the C-channel of the runway 106. This provides a distinct advantage during the assembly process of first locating and then securing the runway to the top of the columns 104.

The gantry system of FIG. 1 is capable of supporting a suspended center load of at least about 1000 pounds as its intended design capacity. In one loading test the system supported a suspended center load of at least about 1000 pounds (up to 1400 lbs.) with the bridge at the midpoint of each runway, without failure or permanent deformation of the runway. Moreover, lifting system 100, including all components except the lifting mechanism 110, weighs less than 700 pounds and more particularly about 667 pounds (lbs.), with the columns each weighing about 100 lbs., the bridge about 75 lbs, and the runways each weighing about 96 lbs. In summary, the lifting system is suitable for lifting loads greater than the weight of the system itself.

Turning now to FIGS. 4-8, showing exemplary assembly details for the compact overhead lifting gantry. As viewed in FIG. 4A, each of the gantry crane runways includes a truss 112 having a C-shaped channel welded along, or possibly forming, the upper chord 204 of truss 112. End truck 500 rolls along the entire length of the two parallel C-channel runways 106. The end trucks each include a plurality of rollers 502 carrying the force of the load and rollers 504 providing directional stability while moving within C-channel runway 106. End trucks 500 provide the connection between the bridge member 108 and runways 106 and are designed for effortless movement along runways 106.

Figure 7:
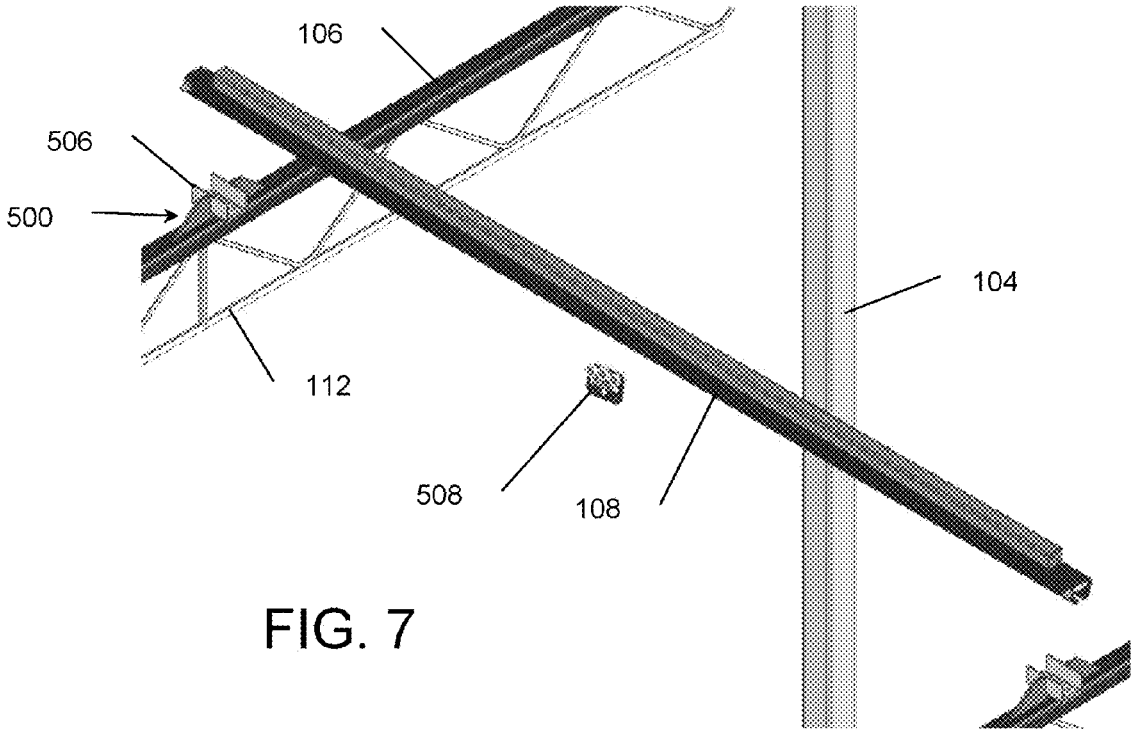
FIG. 7 is a perspective view of the gantry bridge being added to the system by attachment to the end trucks in the runways.
Figure 8:
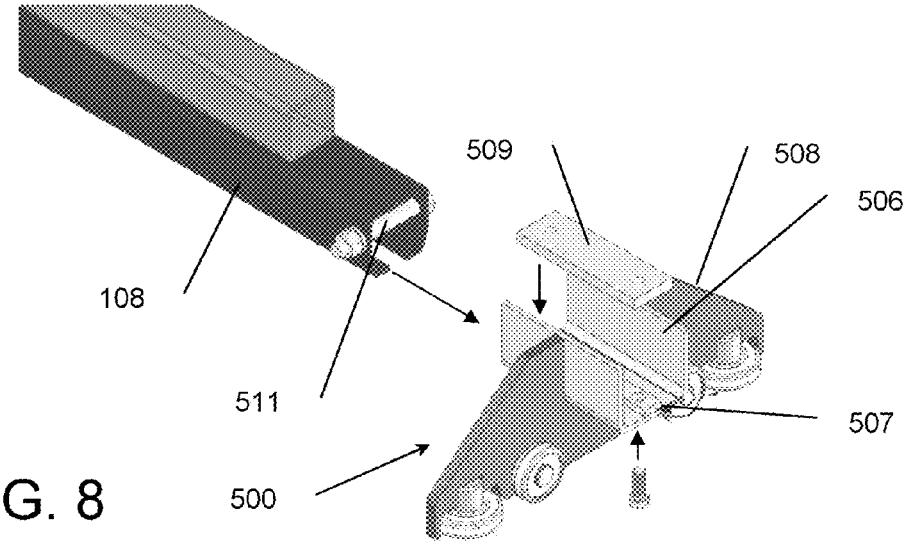
FIG. 8 is a detailed view of the slidable connection between an end truck and one end of the bridge.

Referring briefly to FIGS. 7 and 8, the end truck 500 includes a backplane or web 508 and a mounting bracket 506 for receiving the bridge member 108 for operative attachment to end truck 500. In the illustrated embodiment of FIG. 8 on one end the end truck to bridge member connection provides the ability for the bridge member to slide in and out relative to bracket 506 to compensate for any discrepancies in parallelism between the columns 104 and runway truss pairs 106. More specifically, the inverted C-channel of the bridge member 108 is placed into the mounting bracket 506, around a spacer 507. The spacer, when combined with clamp plate 509, secures the end of the bridge member within the bracket 506, but permits the bridge member to slide relative to the bracket 506 and end truck 500. In combination with the spacer and clamp plate, end stop bolt 511, or equivalently a pin or similar mechanism, prevents the bridge member from disengaging from the end truck. This technique serves to eliminate any potential for binding or skewing of the bridge member as it is supported on and moves a load along runways 106.

Bridge member 108 further comprises a movable attachment point or wheeled trolley 508 engaged with the inverted C-channel that movably connects a lifting mechanism 110 to the bridge member to enable a load to be moved along the span of bridge member 108. Wheels on trolley 508 may have a slight chamfer (e.g., approx. 2-degrees) to match the taper of the inverted C-channel of the bridge member 108, which reduces rolling resistance and wheel wear.

Referring again to FIG. 6, as part of the assembly process, end truck 500 is inserted into the end of C-channel runway 106, as illustrated by arrow 610. Once inserted, bolts or pins are placed through holes 612 in both ends of the C-channel to prevent the end truck 500 from rolling out of either end of runway 106. Thus the end-truck is constrained to freely slide along and within the C-channel while a load is moved within the rectangular perimeter of the gantry 105 (absent a slight loss of travel due to the end trucks themselves coming into contact with the end stop bolts).

As will be appreciated, the C-channel is welded intermittently where the upper chord 204 of truss 112 contacts a back side of the C-channel 106. Such a combination results in a significantly improved strength modulus of the truss/channel assembly. For example, a C-channel span of at least about 170 (up to about 189) inches, supported at the ends only, is capable of supporting a center load of at least about 500 (up to about 700) pounds.

Having described the system in detail, attention is now turned to a description of the process by which the disclosed gantry crane is installed. The process includes having one or two people initially install two pairs of support columns, each of said columns placed in a vertical orientation at respective corners of a rectangular space 105 (FIG. 1). The space, in one configuration, has a length of about 180 inches and a width of about 120 inches. The columns are attached to a level floor or similar substructure using anchor bolts passed through a plate or angle iron attached to the proximal ends of columns 104. Next, each one of a pair of parallel gantry crane runways are attached atop of the columns thereby spanning each of said pair of columns along the length of the rectangular area. The runways are bolted to plates on the distal ends of columns 104, using the suitable hardware (e.g., ½-13 bolts). Once runways 106 are installed atop the columns, the movable bridge member 108 is installed. In one embodiment, end trucks 500 are placed into the runways, and the bridge member 108 is attached perpendicular to, and spanning a distance between the pair of end trucks in the runways. The end trucks, as discussed above, allow bridge member 108 to slidably move along the runways 106; each end of the bridge member moves along a linear path defined by the respective runway.

As discussed above relative to FIG. 8, in one embodiment, only one end of the bridge is clamped solid or bolted to the end truck and the opposite end has a sliding, or floating connection with the respective end truck 500. Such a configuration serves to compensate for any potential runway misalignment at installation or during use. Once the bridge member depicted in FIG. 6 has been installed, with the trolley 508 inserted, a lifting mechanism 110 may then be suspended from the trolley and thus from the movable bridge.

It will be appreciated that variations of the above-disclosed embodiments and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. An improved gantry lifting system, comprising:

at least two pairs of upright support columns arranged to define corners of a rectangular area;

a pair of parallel crane runways spanning each of said pair of columns, said runways being attached to the tops of each pair of columns; wherein each of said runways, comprises an upward opening C-shaped channel in which an end truck is constrained and travels along the length of the channel, said C-shaped channel including at least five sides and four interior angles, and a truss reinforcement attached to a back side of said C-shaped channel, said reinforcement including, in conjunction with said channel, a pair of linear chord members interconnected by a plurality of struts; a movable bridge member perpendicular to and spanning a distance between the pair of runways, said bridge member being slidably connected to the runways by the end trucks operatively positioned within said C-shaped channels to permit the ends of the bridge member to move along a path defined by the respective runways; and a slidable connection attaching a first end of the bridge member to the first of the pair of end trucks and a fixed connection attaching a second, opposite, end of the bridge member to the second of the pair of end trucks.

2. The system of claim 1, further comprising a lifting mechanism suspended from said movable bridge.

3. The system of claim 2, wherein the movable bridge is above the top of the runways.

4. The system of claim 2, wherein the system is installed by two individuals without rigging equipment.

5. The system of claim 1, wherein the system is capable of supporting a suspended load of up to about 1000 pounds and where the weight of the system is less than about 700 pounds.

6. The system of claim 1, wherein each of said truss reinforcements includes a plurality of triangular shaped reinforcement elements formed by a combination of the chords and struts.

7. The system of claim 1, where the ends of the movable bridge are each slidably attached to the runways using the end trucks, and where at least a lower portion of each end truck is captured within the runway and an upper portion of each end truck extends above the runway to interconnect with the bridge.

8. The system of 7, wherein the end trucks each include a plurality of wheels to permit the slidable contact of the end truck with an interior of the C-shaped channel.

9. The system of claim 8, wherein the struts comprise a continuous interconnecting member welded intermittently at the locations where the member contacts either of the pair of linear chord members.

10. The system of claim 8, wherein the C-shaped channel has a span of at least about 170 inches, and when supported at the ends only the C-shaped channel is capable of supporting a center load of at least about 1000 pounds at the midpoint of the runway.

11. The system of claim 7, wherein at least one of said pair of linear chord members is a hollow member permitting the use of an interior portion of the chord as a conduit.

12. The system of claim 1, wherein a width of the upward opening of the C-shaped channel is less than an interior width of the channel.

13. A gantry crane truss runway, comprising:

a single, C-shaped channel including at least five sides and four interior angles, wherein at least two sides are opposing and oriented to define an opening therein facing upward, in which an end truck is retained and travels along the length of the channel; and a truss reinforcement attached to a back side of the C-shaped channel, said reinforcement defining, in conjunction with said C-shaped channel, a plurality of triangular reinforcement sections.

14. The gantry crane runway of claim 13, wherein the truss reinforcement includes:

a continuous linear chord member generally parallel to the C-shaped channel and spanning at least a bottom length of the reinforcement; and a generally continuous, zigzag shaped member that interconnects the C-shaped channel and the lower chord member.

15. The gantry crane runway of claim 14, wherein the continuous linear chord member is hollow thereby permitting the use of the member as a conduit.

16. The gantry crane runway of claim 14, wherein the interconnecting member is welded intermittently where the member contacts a back side of the C-shaped channel.

17. The gantry crane runway of claim 14, wherein a C-shaped channel span of at least 170 inches, supported at the ends only, is capable of supporting a center load of at least about 1000 pounds at the midpoint of both the runways.

18. A method for constructing a gantry crane system, comprising:

install two pairs of support columns, each of said columns placed in a vertical orientation at respective corners of a rectangular region said columns being attached to a level floor or similar substructure using anchoring hardware;

setting upon and then attaching a pair of parallel runways spanning each of said pair of columns along the length of the rectangle, said runways being secured to the tops of the columns, wherein each of said runways comprises an upper, C-shaped channel and a truss reinforcement attached to a back side of said channel, said C-shaped channel including a plurality of sides defining at least four interior angles, said reinforcement including, in conjunction with said C-shaped channel, a pair of linear chord members interconnected by a plurality of struts;

engaging an end truck within each C-shaped channel, where the end truck is retained within and travels along the length of each C-shaped channel;

placing, on top of the runways, and operatively connecting to said end trucks, a movable bridge member perpendicular to and spanning a distance between the pair of gantry crane runways, said bridge member being slidably connected to the runways by means of the end trucks to permit each end of the bridge member to move along a linear path defined by the respective runways.

19. The method of claim 18, further comprising suspending a lifting mechanism from said movable bridge member.

20. The method according to claim 18, wherein the C-shaped channel further includes a longitudinal opening along the length thereof, and where a width of the longitudinal opening is less than an interior width of the C-shaped channel.

* * * * *